US005230605A

United States Patent [19]

Yamaguchi et al.

[11] Patent Number: 5,230,605

[45] Date of Patent: Jul. 27, 1993

[54] AXIAL-FLOW BLOWER

[75] Inventors: Nobuyuki Yamaguchi, Hyogo; Mitsushige Goto, Nagasaki, both of Japan

[73] Assignee: Mitsubishi Jukogyo Kabushiki Kaisha, Tokyo, Japan

[21] Appl. No.: 758,787

[22] Filed: Sep. 12, 1991

[30] Foreign Application Priority Data

Sep. 25, 1990 [JP] Japan ..... 2-256376

[51] Int. Cl.[5] ..... F01D 17/12

[52] U.S. Cl. ..... 415/151; 415/58.5; 415/914

[58] Field of Search ..... 415/148, 150, 151, 160, 415/914, 58.4, 58.5

[56] References Cited

U.S. PATENT DOCUMENTS 3,011,762 12/1961 Pouit ..... 415/914
4,630,993 12/1986 Jensen ..... 415/914
4,673,331 1/1987 Kolb ..... 415/914
4,871,294 10/1989 Ivanov et al. ..... 415/914
4,990,053 2/1991 Rohne ..... 415/914

FOREIGN PATENT DOCUMENTS 1086558 8/1960 Fed. Rep. of Germany .
464431 12/1968 Switzerland .
479427 1/1938 United Kingdom .
672194 5/1952 United Kingdom .

*Primary Examiner*—John T. Kwon
*Attorney, Agent, or Firm*—McGlew and Tuttle

[57] ABSTRACT

An axial-flow blower of stator vane controllable pitch type has an upstream-side opening of an air separator on the upstream side of a controllable pitch type inlet guide vane so that the recirculating flow in the air separator can be joined smoothly with the axial main flow irrespective of the set angle of controllable pitch angle.

8 Claims, 13 Drawing Sheets

AXIAL-FLOW BLOWER

FIELD OF THE INVENTION AND RELATED ART STATEMENT

This invention relates to a stator vane controllable pitch type axial-flow blower having a controllable pitch type inlet guide vane.

To obtain a wider supply range of air quantity and pressure of an axial-flow blower, a mechanism for making the pitch of rotor vanes controllable or that for making the pitch of stator vanes controllable has so far been used. It is generally said that the rotor vane controllable pitch type blower has a wider operation range than the stator vane controller pitch type blower and also can be operated with high efficiency in a wider range. On the other hand, the rotor vane controllable pitch type blower is expensive because it requires a complex mechanism in the rotating hub. The stator vane controllable pitch type blower is less expensive, but has a narrow range in which it can be operated with high efficiency.

Now, the controllable pitch type blower having an inlet guide vane (IGV) which is classified as the stator vane controllable pitch type will be described by reference to FIG. 13.

Referring to FIG. 13, reference numeral 1 denotes an inlet guide vane, 2 a rotor vane, 3 an outlet guide vane, 4 a rotating hub at the periphery of which a plurality of rotor vanes are positioned, and 5 denotes a rotating shaft fixedly secured to the hub 4. Reference numeral 6 denotes a fan casing, 7 a front inside cylinder in front of the rotor vane 2, 8 a rear inside cylinder in rear of the rotor vane 2, 9 a supporting shaft for inlet guide vane, 10 a lever for turning the inlet guide vane 1, and 11 a rotation centerline of the rotating shaft 5.

With this arrangement, when the rotating shaft 5 is rotated around the rotation centerline 11 by an electric motor (not shown), the rotating hub 4 rotates together with the rotor vanes 2, so that air is sent in the direction of the arrow a. The turning of the lever 10 around the supporting shaft 9 by an actuator (not shown) changes the vane angle of the inlet guide vane 1 so that the air quantity is changed.

FIG. 14 indicates the set angle $\Delta\theta_{IGV}$ of the inlet guide vane 1. The set angle $\Delta\theta_{IGV}$ of the inlet guide vane 1 is 0° when the inlet guide vane is in parallel with the axial direction as shown by the solid line in FIG. 14. When the inlet guide vane is at the position shown by the dash-and-dot line 13, the set angle has the plus (+) sign, and when the inlet guide vane is at the position shown by the dash-and-dot line 14, the set angle has the minus (−) sign.

FIG. 15 shows the performance curves for the above-described blower. In FIG. 15, the ordinates represent the pressure increase ΔP and the abscissae the air quantity Q. A certain range defined by the performance curve group shown by the solid lines plotted under the condition of $\Delta\theta_{IGV}$=constant provides the operation range of this blower. It is a stall point for each performance curve that restricts this range. The broken line 16 is a line connecting the stall points. The operation curve for blower is usually indicated by a dash-and-dot line. On the small air quantity side from the intersection 18 of the surge line 16 and the operation line 17, air cannot be supplied stably. To widen the operation range, the surge line 16 must be shifted to the small air quantity side.

Next, an air separator installed in the axial-flow blower will be described by reference to FIG. 16. In FIG. 16, reference numeral 19 denotes an air separator, which is installed in a projecting form at a part of the fan casing 6 at the upstream side from the leading edge of rotor vane 2. Reference numeral 20 denotes a straightening vane, and 21 denotes a ring. The ring 21, being secured to the straightening vane 19, serves to separate the air separator 19 from the main flow portion. In FIG. 16, reference numeral 22 denotes a rotor vane tip opening, and 23 denotes an upstream-side opening.

When the stall condition is approached during the operation of axial-flow blower, a small stall zone occurs at the tip of rotor vane 2. This stall zone is sucked into the rotor vane tip opening 22. The swirling motion is eliminated from the sucked air when the air passing through the straightening vane 20, and the sucked air is straightened in the axial direction and returned to the main flow through the upstream-side opening 23. Thus, a recirculating flow 24 (a recirculating flow passage) is formed. The joining of this recirculating flow with the main flow delays stalling. If the air separator is absent, the stall zone occurring at the tip of the rotor vane 2 grows gradually as shown by the solid line 26 in FIG. 17, accelerating the stalling. (The broken line 27 in FIG. 17 indicates the characteristics of the blower of this invention described later.)

Although the conventional axial-flow blower of stator vane controllable pitch type described above is simple in construction and low in cost, it has a disadvantage of narrow range in which it can be operated with high efficiency. To widen the operation range of an axial-flow blower, a mechanism for varying the pitch of rotor vanes may be used. This method, however, makes the mechanism in the rotating hub complex, leading to high costs for manufacturing a blower.

OBJECT AND SUMMARY OF THE INVENTION

Accordingly, it is the primary object of this invention to provide an axial-flow blower improved by using both the controllable pitch type inlet guide vane classified as the inexpensive stator vane controllable pitch type blower and an air separator.

In other words, it is the object of this invention to provide an axial-flow blower which is less expensive and has a wide range in which it can be operated with high efficiency.

To achieve the above object, the axial-flow blower of this invention having controllable pitch type inlet guide vanes comprises an air separator which has a casing portion projecting outward in a ring form at the upstream side from the leading edge of rotor vane and in which a plurality of straightening vanes are arranged in the circumferential direction to form a recirculating flow passage, and an upstream opening disposed on the upstream side of the controllable pitch type inlet guide vane or at the casing portion corresponding to the upstream side from the front half of the controllable pitch type inlet guide vane.

DETAILED DESCRIPTION OF PREFERRED EMBODIMENTS

The embodiments of this invention will be described in detail by reference to the drawings.

Figure 1A:
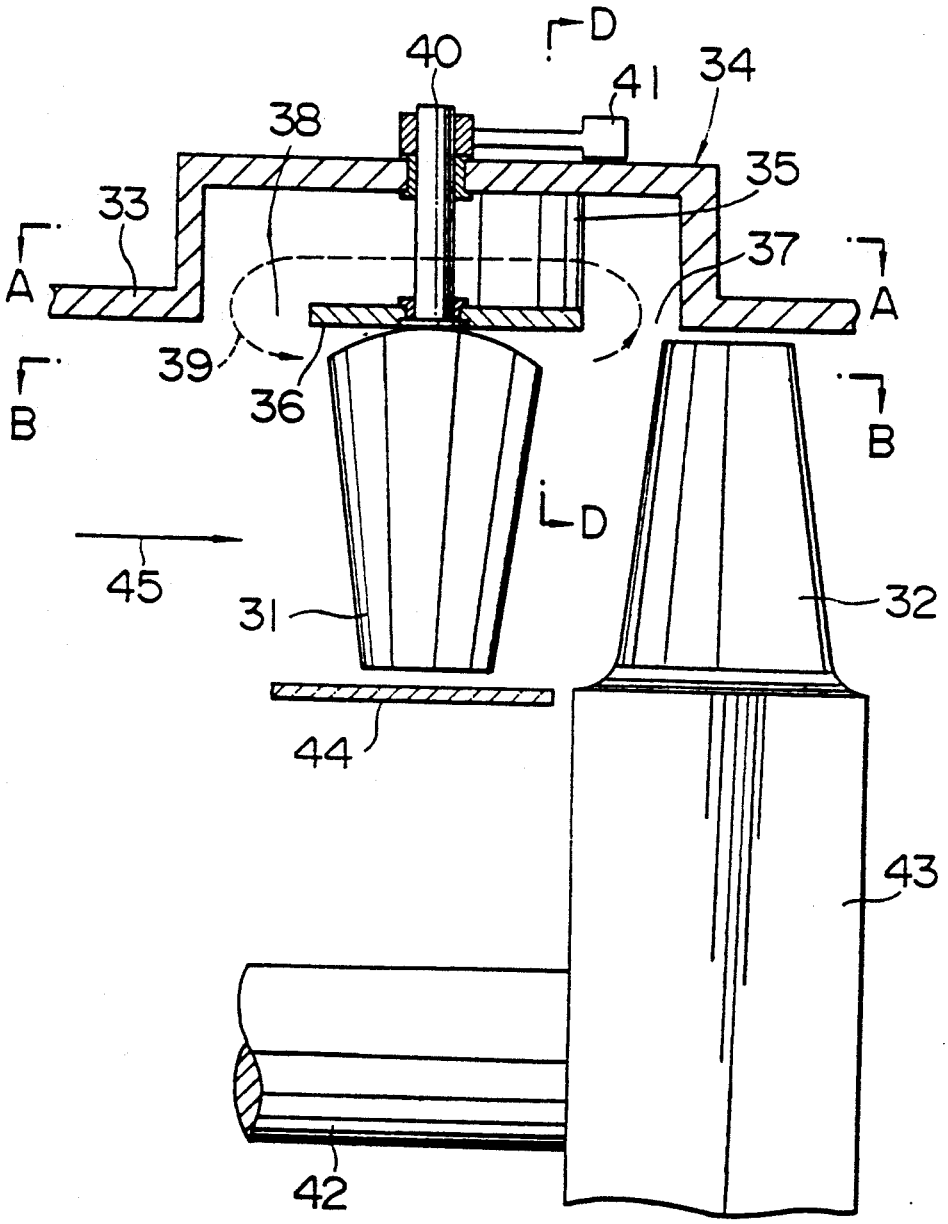
FIG. 1(*a*) is a sectional view of the main portion of one embodiment of the axial-flow blower according to this invention, FIG. 1(*b*) is a sectional view of the main portion of another embodiment of the axial-flow blower according to this invention.
Figure 1B:
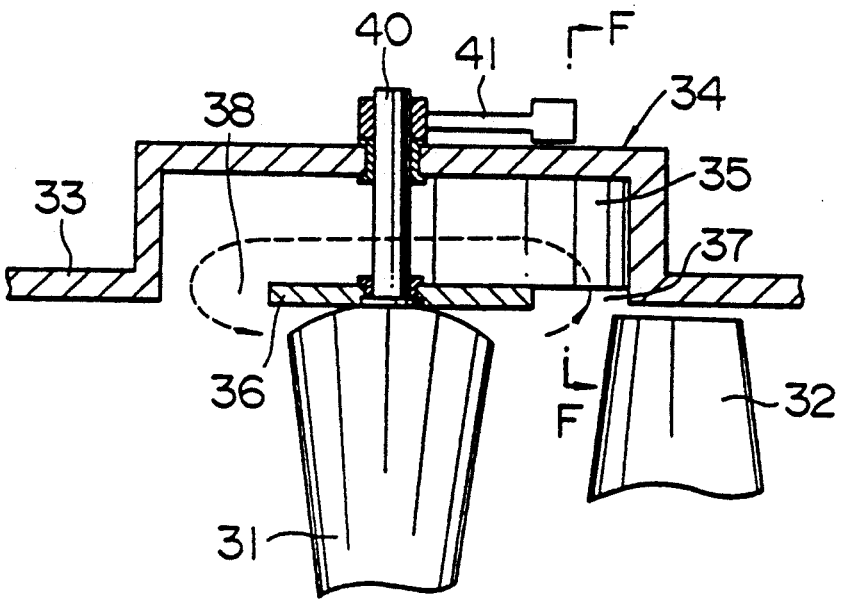
Figure 2:
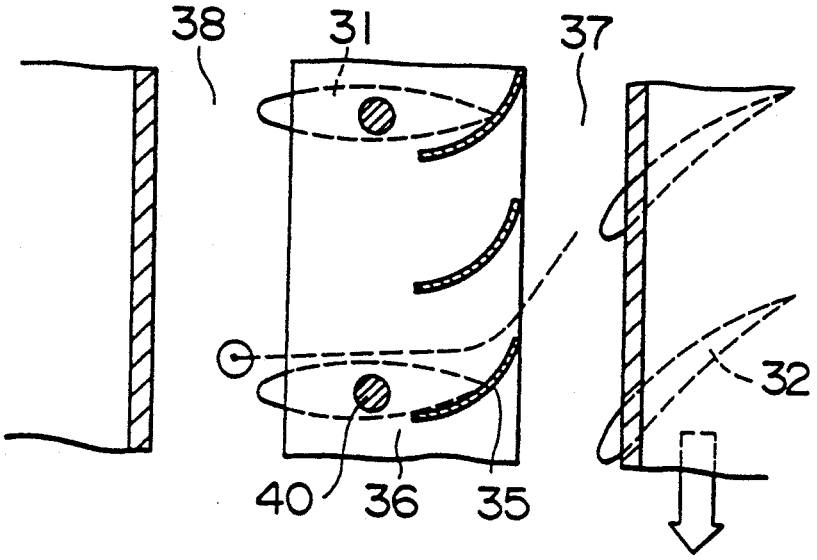
FIG. 2 is a sectional view taken on the plane of the line A—A of FIG. 1(*a*)

FIGS. 1(*a*), 2 and 3 show one embodiment of this invention, and FIG. 1(*b*) shows another embodiment of this invention. In these figures, reference numeral 31 denotes an inlet guide vane, 32 a rotor vane, 33 a fan casing, 34 an air separator, 35 a curved straightening vane, 36 a ring on which a plurality of straightening vanes 35 are secured vertically, 37 a rotor vane tip opening, 38 an upstream-side opening, and 39 a recirculating flow.

The air separator 34 is projected in a ring form at a part of the fan casing 33 on the upstream side from the leading edge of rotor vane 32. In the air separator 34, curved straightening vanes 35 are arranged with the rotor vane tip opening 37 being interposed, which forms a recirculating flow passage which produces a recirculating flow 39.

The ring 36 is secured to the straightening vane 35 and positioned coaxially with the fan casing 33, having the same inside diameter as that of the fan casing 33. In the embodiment shown in FIG. 1(*a*), the rear end of the straightening vane 35 coincides with the rear end of the ring 36, and the straightening vane 35 is substantially circular at a cross section of cylinder.

The inlet guide vane 31 is supported by an inlet guide vane supporting shaft 40 which passes through the air separator 34 and the ring 36, and a plurality of the inlet guide vanes are arranged in the circumferential direction.

A lever 41, being disposed at the portion of the inlet guide vane supporting shaft 40 projecting from the fan casing 33, is so constructed that the rotating angle of inlet guide vane 31 can be changed by the operation of the lever 41.

Next, we will describe the relationship between the inlet guide vane 31, the ring 36, and the upstream-side opening 38, which is a feature of this invention.

The ring 36 extends to the upstream side from the leading edge of the rotor vane 32 so that the upstream-side opening 38 is positioned on the upstream side from the inlet guide vane 31. On the downstream side of the inlet guide vane 31, a plurality of rotor vanes 32 are disposed at the periphery of the rotating hub 43 secured to the rotating shaft 42. On the inner side of the inlet guide vane 31, a front inside cylinder 44 is disposed.

With this arrangement, minor fluid stall occurring at the tip of the rotor vane 32 during the operation of the axial-flow blower, which has swirling motion in the same direction as the rotor vane 32, is forced into the rotor vane tip opening 37. The swirling motion is eliminated by the straightening vanes 35, so that the recirculating flow 39 which has been returned to the axial direction is returned to the main flow portion through the upstream-side opening and joins smoothly with the axial flow 45 in the main flow portion. This causes a delay in stalling, enabling us to obtain an axial-flow blower having a wide operation range.

In this case, it is important that the recirculating flow joins smoothly with the main flow. If the recirculating flow cannot join with the main flow smoothly, turbulence occurs in the main flow, resulting in stalling at an earlier stage. If the upstream-side opening 38 of the air separator 34 is positioned on the downstream side of the controllable pitch type inlet guide vane, the recirculating flow 39 in the axial direction joins with the main flow which already has a swirling motion, generating turbulence in the main flow, which easily causes stalling. In this case, the turbulence is not generated only when $\Delta\theta_{IGV}$ is equal to or close to 0°, but it may be generated when $|\Delta\theta_{IGV}|\neq 0°$.

The feature of this invention will be more specifically described by reference to FIGS. 5 through 8.

Figure 5:
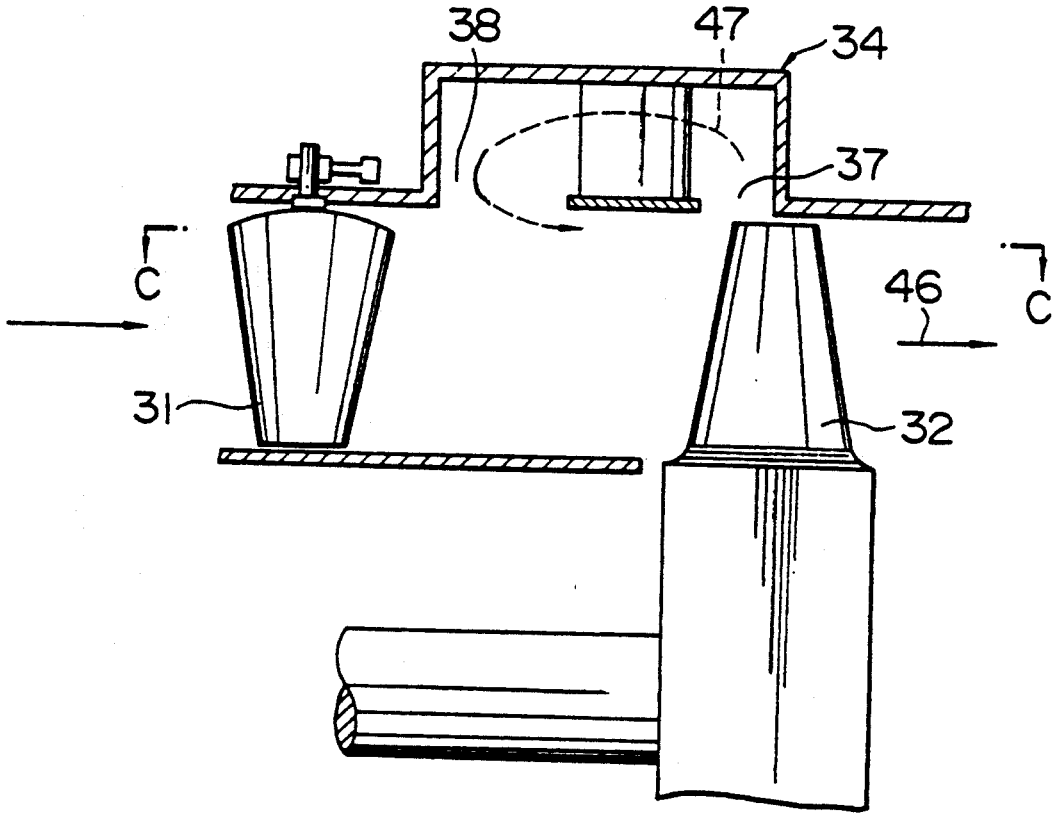
FIG. 5 is a sectional view of the main portion of the axial-flow blower in which an air separator is disposed between the controllable pitch type inlet guide vane and the rotor vane.
Figure 6:
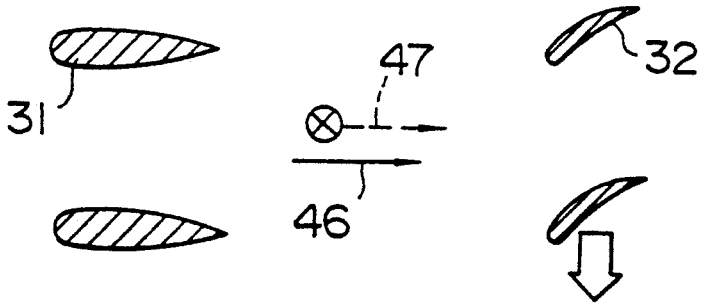
FIG. 6 is a sectional view taken on the plane of the line C—C of FIG. 5 for the inlet guide vane set angle $\Delta\theta_{IGV}=0°$.
Figure 7:
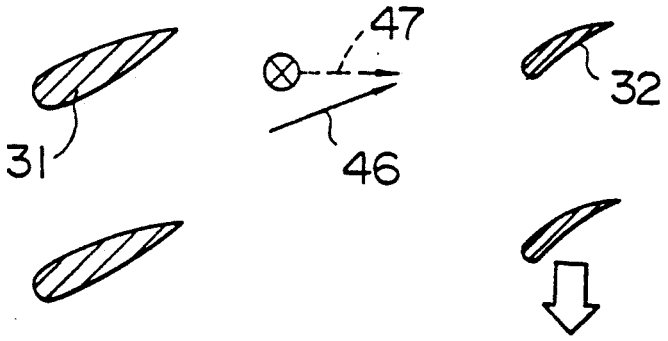
FIG. 7 is a sectional view taken on the plane of the line C—C of FIG. 5 for the set angle $\Delta\theta_{IGV}>0°$.
Figure 8:
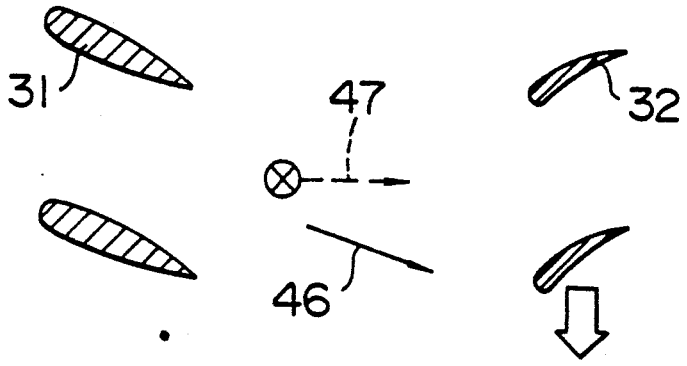
FIG. 8 is a sectional view taken on the plane of the line C—C of FIG. 5 for the set angle $\Delta\theta_{IGV}<0°$, FIGS. 9(*a*) and 9(*b*) are sectional views of the main portion of further embodiments of the axial-flow blower according to this invention, FIG. 10(*a*) is a sectional view taken on the plane of the line D—D of FIG. 1(*a*), FIG. 10(*b*) is a sectional view taken on the plane of the line E—E of FIG. 10(*a*), FIG. 11(*a*) is a sectional view taken on the plane of the line F—F of FIG. 1(*b*), FIG. 11(*b*) is a sectional view taken on the plane of the line G—G of FIG. 11(*a*), FIG. 12(*a*) is a sectional view taken on the plane of the line F—F of FIG. 10(*a*) of another embodiment, FIG. 12(*b*) is a sectional view taken on the plane of the line H—H of FIG. 12(*a*)

As shown in FIG. 5, the air separator 34 is positioned between the inlet guide vane 31 and the rotor vane 32 in the axial direction. The flows of air at the cross section along the line C—C of FIG. 5 are shown in FIGS. 6 through 8. In these figures, the main flow 46 in the downstream of the inlet guide vane 31 is indicated by a solid line, and the flow 47 from the air separator 34 is indicated by a broken line. The flow 47 from the air separator 34 is directed in the axial direction, and the flow 47 joins smoothly with the flow 46 in the downstream of the inlet guide vane only when $\Delta\theta_{IGV}=0°$ as shown in FIG. 6. In other cases, the direction of the flow 46 does not coincide with that of the flow 47, which generates turbulence and may cause stalling earlier, as shown in FIG. 7 ($\Delta\theta_{IGV}>0°$) and FIG. 8 ($\Delta\theta_{IGV}<0°$). Therefore, the change of pitch of inlet guide vane has little effect unless $\Delta\theta_{IGV}$ is equal to or close to 0°.

To overcome such a drawback, namely, to get proper joining of flows when the inlet guide vane has any pitch angle, the upstream-side opening 38 of the air separator 34 must be positioned on the upstream side of the inlet guide vane which always produces the main flow.

Figure 3:
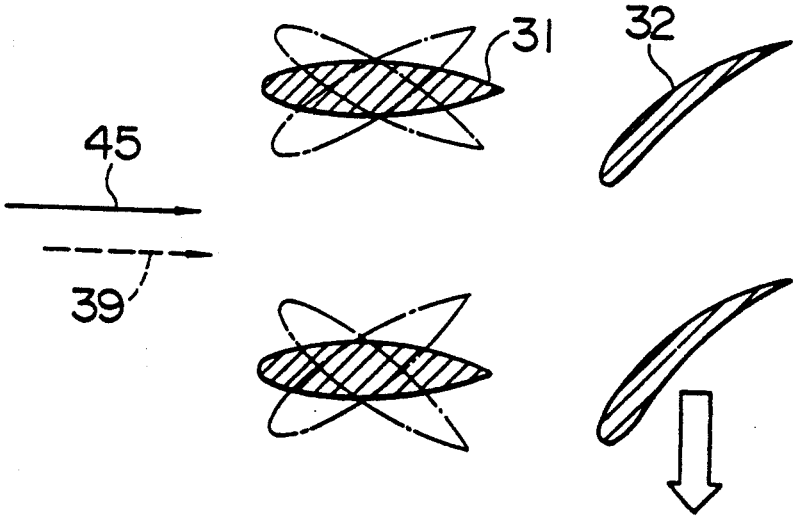
FIG. 3 is a sectional view taken on the plane of the line B—B of FIG. 1(*a*)

With this arrangement, the main flow 46 and the flow 47 from the air separator 34 are always directed in the axial direction and joins smoothly with each other irrespectively of the direction of the inlet guide vane 31 as shown in FIG. 3.

Figure 4:
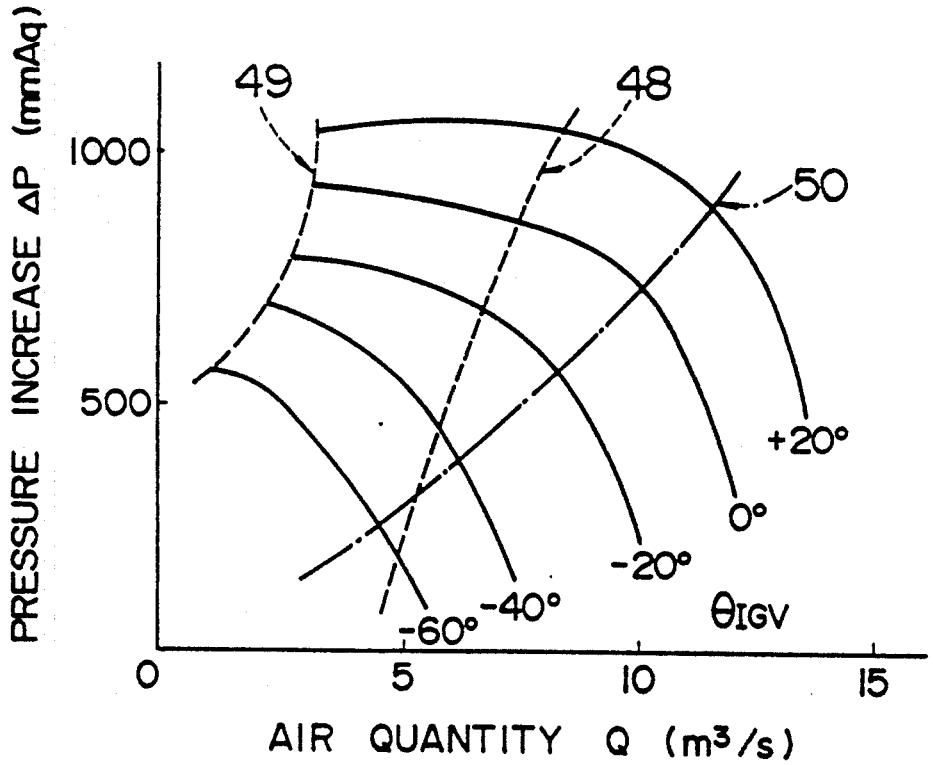
FIG. 4 is a diagram showing the performance curves for the axial-flow blower according to this invention.

In FIG. 4, this improvement shifts the surge line 48 as a whole to the surge line 49 at the small air quantity side, so that the blower can be operated with sufficient allowance in the whole range of air quantity in relation to the operation line 50.

FIGS. 1(*b*), 11(*a*), and 11(*b*) show another embodiment of this invention. In the embodiment shown in FIG. 1(*b*), the rear end of the straightening vane 35 extends beyond the rear end of the ring 36 to the end face of the fan casing 33 near the leading edge of the rotor vane. In addition, the straightening vane 35 is substantially circular in the plane in the radial direction so that it can draw the flow from the rotor vane tip. Thus, the straightening of flow is performed by turning the drawn flow in the axial direction.

Figure 11A:
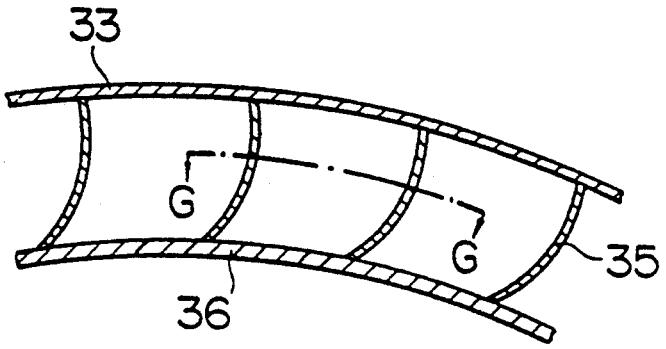
Figure 11B:
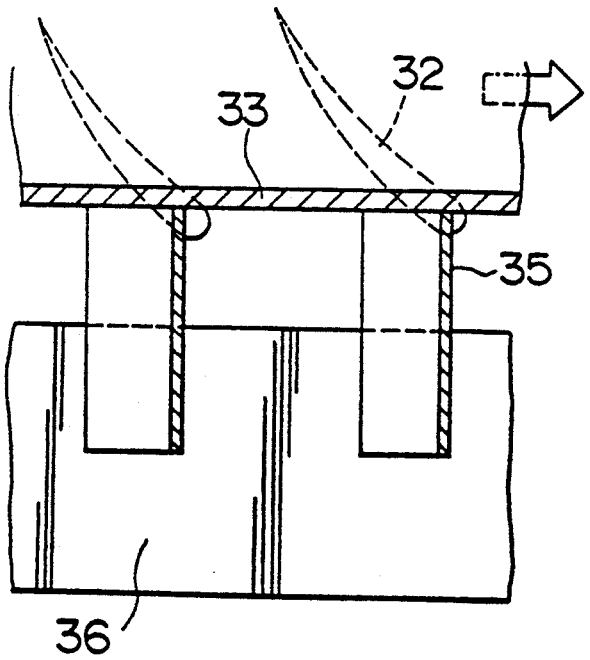
Figure 12A:
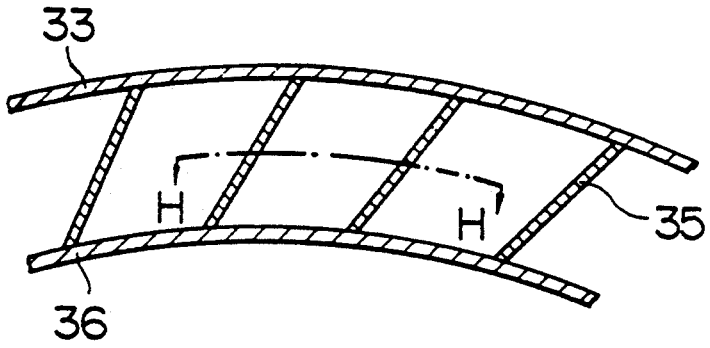
Figure 12B:
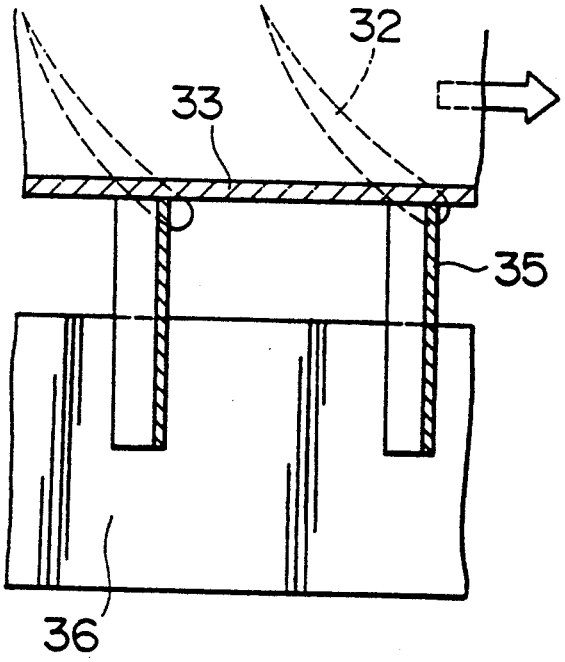
Figure 13:
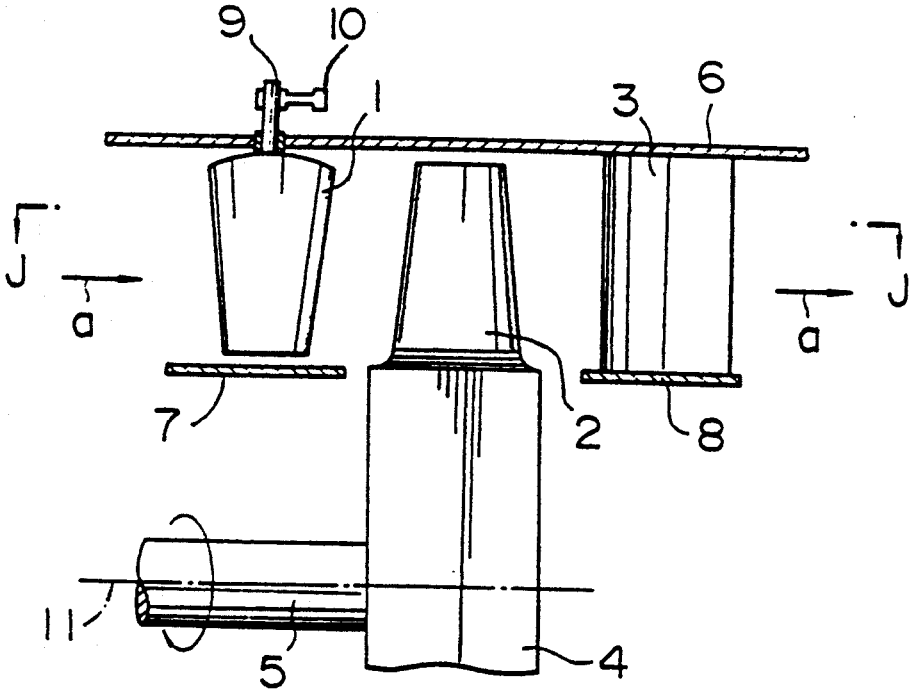
FIG. 13 (PRIOR ART)
FIG. 13 is a sectional view of a conventional axial-flow blower having controllable pitch type inlet guide vanes.
Figure 14:
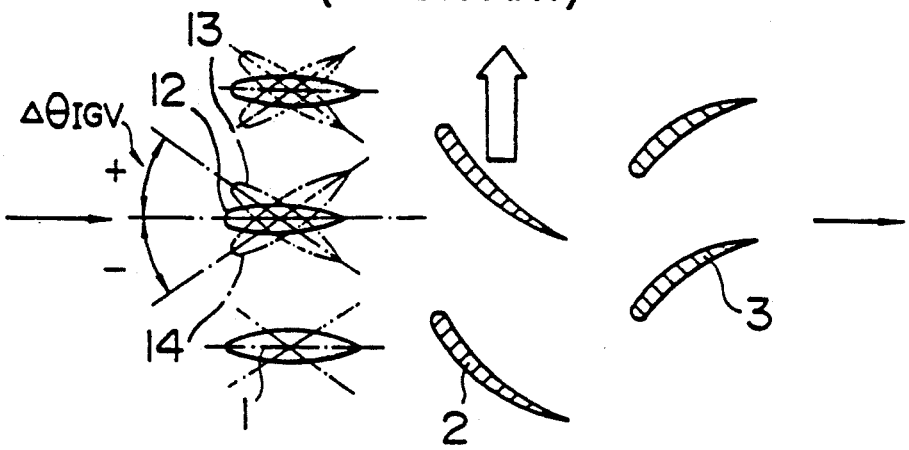
FIG. 14 (PRIOR ART)
FIG. 14 is a sectional view taken on the plane of the line J—J of FIG. 13.
Figure 15:
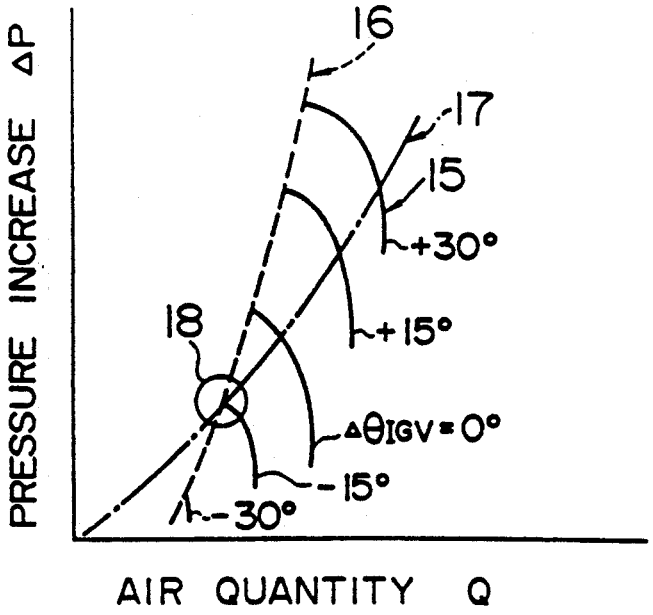
FIG. 15 (PRIOR ART)
FIG. 15 is a diagram showing the performance curves for the conventional axial-flow blower of FIG. 13.
Figure 16:
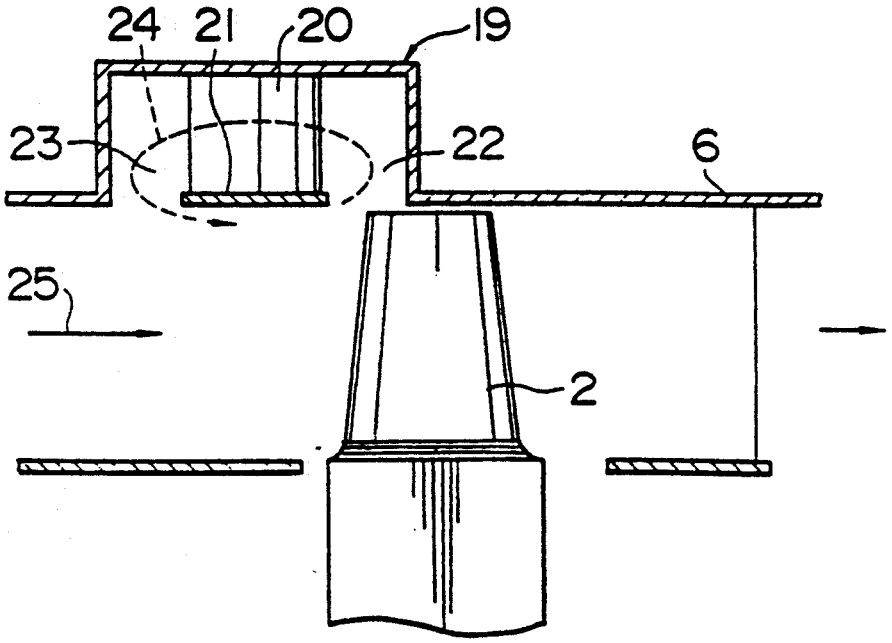
FIG. 16 (PRIOR ART)
FIG. 16 is a partial sectional view of a conventional axial-flow blower having an air separator.
Figure 17:
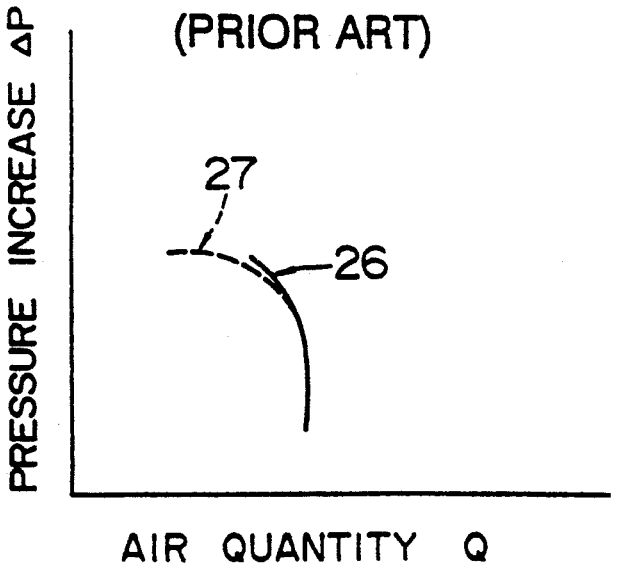
FIG. 17 (PRIOR ART)
FIG. 17 is a diagram showing the performance curves for the conventional axial-flow blower having an air separator.

FIGS. 12(*a*) and 12(*b*) show another embodiment based on the same principle as that shown in FIGS. 11(*a*) and 11(*b*). In this embodiment, the straightening vane 35 is straight in the cross section along the line F—F of FIG. 1(*b*). The function of the straightening vane 35 in this embodiment is similar to that in the above-described embodiment.

Figure 9A:
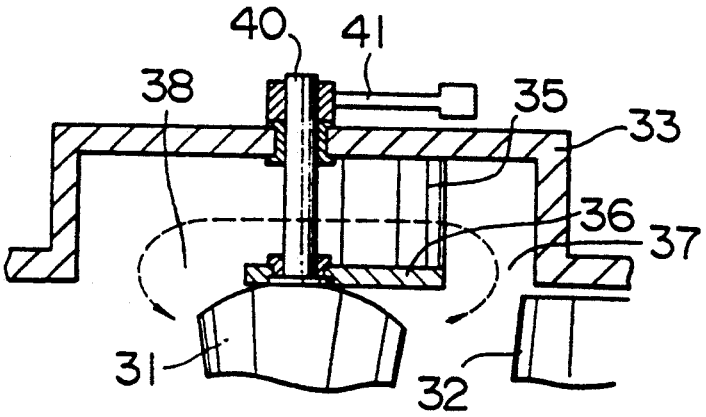
Figure 9B:
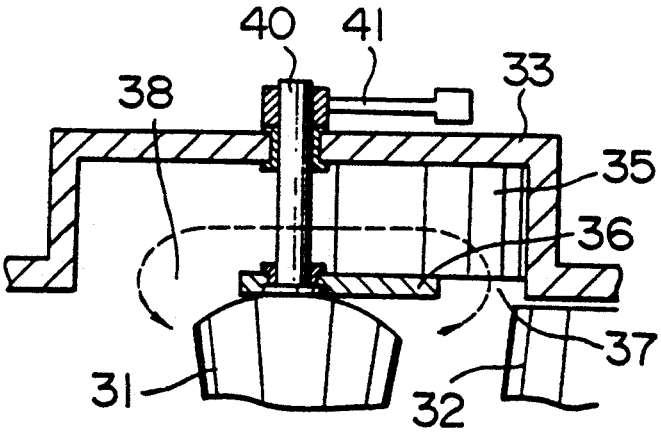
Figure 10A:
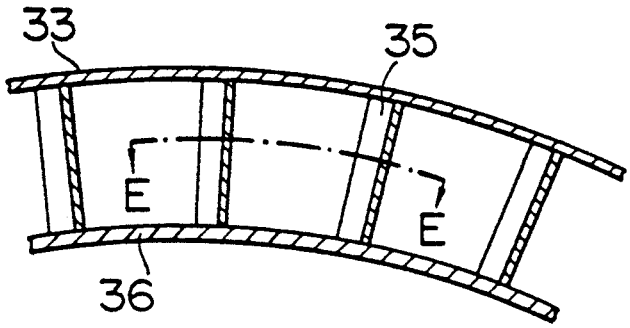
Figure 10B:
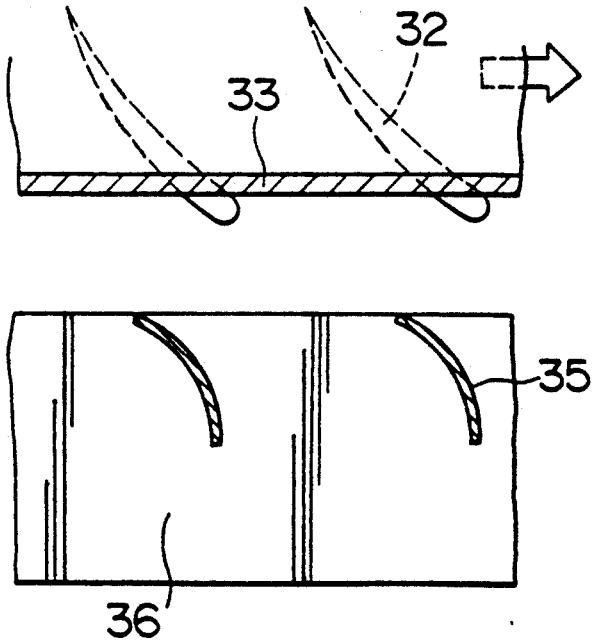

FIGS. 9(*a*) and 9(*b*) show further embodiments of this invention. In these embodiments, the positional relationship among the inlet guide vane 31, the ring 36, and the upstream-side opening 38 is such that the upstream-side opening 38 is positioned at the upstream side from the front half of the inlet guide vane 31. The ring 36 is shortened on its upstream side, while it is extended to the downstream portion of the inlet guide vane 31 on its downstream side.

The embodiments described above by reference to FIGS. 9, 11, and 12 also have the same effect as that of the embodiment shown in FIG. 1(*a*).

In the embodiments according to this invention, even when the pitch angle (vane angle) of the inlet guide vane 31 is set at any angle, a minor stall zone occurring at the tip of the rotor vane, which has a swirling motion in the same direction as the rotor vane, is sucked into the rotor vane tip opening. The swirling motion is eliminated from the sucked air by the straightening vanes 20, and the sucked air is straightened in the axial direction and returned to the main flow through the upstream-side opening, joining smoothly with the axial main flow. This process delays stalling, enabling us to get an axial-flow blower having a wide operation range at any pitch angle of controllable pitch type inlet guide vanes.

Therefore, this invention has a great advantage of providing an axial-flow blower which is less expensive and highly efficient and has a wide operation range.

This invention is not limited to the embodiments described above, but all changes and modifications thereof, without constituting departures from the spirit and scope of this invention, are intended to be included.

We claim:

1. An axial-flow blower having controllable pitch type inlet guide vanes comprising:

an air separator which has a casing portion projecting outward in a ring form on the upstream side from the leading edge of a rotor vane and in which a plurality of straightening vanes are arranged in a circumferential direction to form a recirculating flow passage, and an upstream-side opening disposed on the upstream side of the controllable pitch type inlet guide vane.

2. An axial-flow blower according to claim 1 wherein a ring having a same inside diameter as that of said casing is disposed coaxially in said casing, said ring having said straightening vanes secured thereto, and wherein said inlet guide vanes are secured rotatably.

3. An axial-flow blower according to claim 1 or 2 wherein said straightening vanes are formed in a circular or straight shape.

4. An axial-flow blower according to claim 3 wherein the rear end of said straightening vane coincides with the rear end of said ring.

5. An axial-flow blower according to claim 3 wherein the rear end of said straightening vane extends beyond the rear end of said ring to the end face of said casing near the leading edge of said rotor vane.

6. An axial-flow blower according to claim 1 wherein said upstream-side opening of said air separator, which is formed on the upstream side of said ring, is positioned on the upstream side from the front half of said inlet guide vane.

7. An axial-flow blower comprising:

a fan casing;

a rotor vane rotating inside said fan casing and moving a fluid through said fan casing;

an air separator positioned upstream of said rotor vane, said air separator having an air separator casing portion projecting outward in a ring form from said fan casing, said air separator also having a plurality of straightening vanes arranged in a circumferential direction to form a recirculating flow passage, said air separator having an upstream-side opening disposed on an upstream side of said rotor vane; and a controllable pitch type inlet vane positioned in said fan casing upstream of said rotor vane and downstream of said upstream-side opening of said air separator.

8. An axial-flow blower having controllable pitch type inlet guide vanes comprising:

an air separator which has a casing portion projecting outward in a ring form on the upstream side from the leading edge of rotor vane and in which a plurality of straightening vanes are arranged in a circumferential direction to form a recirculating flow passage, and an upstream-side opening disposed at the casing portion corresponding to the upstream side of the controllable pitch type inlet guide vane.

* * * * *